US005221435A

United States Patent [19]

Smith, Jr.

[11] Patent Number: 5,221,435

[45] Date of Patent: Jun. 22, 1993

[54] PAPERMAKING PROCESS

[75] Inventor: James H. Smith, Jr., Warrenville, Ill.

[73] Assignee: Nalco Chemical Company, Naperville, Ill.

[21] Appl. No.: 766,310

[22] Filed: Sep. 27, 1991

[51] Int. Cl.[5] ..... D21H 21/10

[52] U.S. Cl. ..... 162/164.1; 162/164.3; 162/164.6; 162/168.1; 162/168.2; 162/168.3; 162/175; 162/181.1; 162/181.2; 163/181.3; 163/183

[58] Field of Search ..... 162/168.1, 168.2, 168.3, 162/175, 181.1, 181.2, 181.3, 181.4, 181.5, 181.6, 181.8, 183, 164.3, 164.6, 164.1

[56] References Cited

U.S. PATENT DOCUMENTS

| | | | |
|---|---|---|---|
| 3,117,944 | 1/1964 | Harrell | 260/41 |
| 4,388,150 | 6/1983 | Sunden et al. | 162/175 |
| 4,643,801 | 2/1987 | Johnson | 162/164.2 |
| 4,753,710 | 6/1988 | Langley et al. | 162/164.3 |
| 4,874,466 | 10/1989 | Savino | 162/164.3 |
| 4,913,775 | 4/1990 | Langley et al. | 162/164.3 |

FOREIGN PATENT DOCUMENTS

| | | |
|---|---|---|
| 759363 | 5/1967 | Canada . |
| 0276200 | 9/1988 | European Pat. Off. . |
| 295794 | 12/1988 | Japan . |
| 8600100 | 6/1985 | PCT Int'l Appl. . |
| 8605826 | 10/1986 | PCT Int'l Appl. . |
| 631483 | 11/1949 | United Kingdom . |

OTHER PUBLICATIONS

Encyclopedia of Chemical Technology, Kirk and Othmer, vol. 16, pp. 744–785 and 788–791.

Encyclopedia of Chemical Technology, Kirk and Othmer, vol. 16, pp. 804–810.

"Silicates in Paper Products Improve Strength and Function Peformance", James S. Falcone et al., Pulp & Paper, Jan. 1976, pp. 93–96.

Literature Search on Retention/drainage Aids, dual systems, (search No. 3269), pp. 5–6, 19–22, 100–103, 136–139, 193–198, and 261–262.

Literature Search on Use of Colloidal Alumina As a Retention Aid, 3 pp.

Literature Search entitled Particles Used in Retention/-drainage Programs, pp. R1 to R11, and Table 1.

*Primary Examiner*—Peter Chin

*Attorney, Agent, or Firm*—Joan I. Norek; Robert A. Miller; Joseph B. Barrett

[57] ABSTRACT

In a papermaking process a paper product is formed from a mineral filler containing cellulosic slurry. Retention performance is provided by the sequential addition of a cationic charge-biasing species, an anionic flocculant, and then a certain microparticle. A shear stage is interposed between the flocculant addition and the microparticle addition. The microparticle is a inorganic, cationic source of aluminum.

23 Claims, No Drawings

PAPERMAKING PROCESS

TECHNICAL FIELD OF THE INVENTION

The present invention is in the technical field of papermaking, and more particularly in the technical field of wet-end additives to papermaking furnish.

BACKGROUND OF THE INVENTION

In the manufacture of paper an aqueous cellulosic suspension or slurry is formed into a paper sheet The cellulosic slurry is generally diluted to a consistency (percent dry weight of solids in the slurry) of less than 1 percent, and often below 0.5 percent ahead of the paper machine, while the finished sheet must have less the 6 weight percent water. Hence the dewatering aspects of papermaking are extremely important to the efficiency and cost of the manufacture.

The dewatering method of the least cost in the process is drainage, and thereafter more expensive methods are used, for instance vacuum, pressing, felt blanket blotting and pressing, evaporation and the like, and in practice a combination of such methods are employed to dewater, or dry, the sheet to the desired water content. Since drainage is both the first dewatering method employed and the least expensive, improvement in the efficiency of drainage will decrease the amount of water required to be removed by other methods and hence improve the overall efficiency of dewatering and reduce the cost thereof.

Another aspect of papermaking that is extremely important to the efficiency and cost of the manufacture is retention of furnish components on and within the fiber mat being formed during papermaking. A papermaking furnish contains generally particles that range in size from about the 2 to 3 millimeter size of cellulosic fibers, to fillers at a few microns, and to colloids. Within this range are cellulosic fines, mineral fillers (employed to increase opacity, brightness and other paper characteristics) and other small particles that generally, without the inclusion of one or more retention aids, would in significant portion pass through the spaces (pores) between the cellulosic fibers in the fiber mat being formed during papermaking.

One method of improving the retention of cellulosic fines, mineral fillers and other furnish components on the fiber mat is the use of a coagulant/flocculant retention system, added ahead of the paper machine. In such a system there is first added a coagulant, for instance an inorganic coagulant such as alum (aluminum sulfate), or a cationic starch, or a low molecular weight synthetic cationic polymer to the furnish. Such a coagulant generally reduces the negative surface charges present on the particles in the furnish, particularly the surface charges of the cellulosic fines and the mineral fillers, and thereby accomplishes some degree of agglomeration of such particles. After the addition of such coagulant, and after the various significant shear steps of the refining process, there is then added a flocculant. A flocculant generally acts by bridging between particles. A flocculant such as a synthetic anionic polymer is generally fixed onto the furnish particles through the previously added coagulant material which, having been to some extent adsorbed onto the anionic surfaces within the furnish, provides sites of attachment for the anionic flocculant. The synthetic anionic flocculants generally have a thin, flexible nature, and hence are added at a point providing sufficient time lapse before sheet formation to permit the polymer to reach the attachment surfaces, but not so long as to allow polymer reconfiguration. For similar reasons, such retention systems are deemed shear sensitive, and significant shear conditions are to be avoided at least after the flocculant addition.

As noted above, the flocculant of such a coagulant/flocculant retention system bridges the particles and/or agglomerates already formed by the coagulant, from one surface to another, binding the particles into large agglomerates. The presence of such large agglomerates in the furnish as the fiber mat of paper sheet is being formed increases retention. The agglomerates are filtered out of the water onto the fiber web, where unagglomerated particles would, to a great extent, pass through such paper web.

A flocculated agglomerate generally does not interfere with the drainage of the fiber mat to the extent that would occur if the furnish were gelled or contained an amount of gelatinous material. Nonetheless when such flocs are filtered by the fiber web the pores of the web are generally reduced to a degree, reducing drainage efficiency therefrom. Thus the increased retention provided by a retention system may be achieved with a concomitant lessening of drainage efficiency.

Another type of retention system is described in U.S. Pat. Nos. 4,753,710 and 4,913,775, inventors Langley et al., issued respectively Jun. 28, 1988, and Apr. 3, 1990. In brief, such method adds to an aqueous cellulosic papermaking suspension first a high molecular weight linear cationic polymer, followed by subjecting the suspension to high shear conditions, and then adds bentonite prior to sheet formation.

A further type of retention system is described in "Microparticles in Wet End Chemistry", Kurt Moberg, Retention and Drainage Short Course, 1989, Washington, D.C., TAPPI Press, Altanta, Ga. In brief, such "microparticle" system starts with the addition of cationic starch, followed by the additional of colloidal silica.

Greater retention of fines and fillers permits, for a given grade of paper, a reduction in the cellulosic fiber content of such paper. As pulps of less quality are employed to reduce papermaking costs, the retention aspect of papermaking becomes even more important because the fines content of such lower quality pulps is greater generally than that of higher quality pulps.

Greater retention of fines, fillers and other slurry components reduces the amount of such substances that are lost to the white water, and hence reduces the amount of material wastes, the cost of waste disposal, and the adverse environmental effects therefrom.

Another important characteristic of a given papermaking process is the formation of the paper sheet produced. Formation is determined by the variance in the light transmission within a paper sheet, and a high variance is indicative of poor formation. As retention increases to a high level, for instance a retention level of 80 or 90 percent, the formation parameter generally abruptly declines from good formation to poor formation, It has been at least theoretically postulated that as the retention mechanisms of a given papermaking process shift from floc filtration to floc adsorption, the deleterious effect on formation, at high retention levels, will diminish. A good combination of retention and formation is attributed to the use of bentonite in U.S. Pat. No. 4,913,775, noted above. Improved dewatering and a larger fraction of retention by adsorption rather than filtration, is attributed to the cationic starch/colloidal silica system in "Microparticles in Wet End Chemistry" noted above.

It is generally desirable to reduce the amount of material employed for given purposes in a papermaking process, if such reduction can be achieved without significantly diminishing the result sought. Such add-on reductions may realize both a material cost savings and handling and processing benefits. The reduction in concentration of an add-on employed may in instances advantageously diminish various deleterious effects of such add-on. For instance, high levels of alum may result in deposit problems on the machine, and be detrimental to dry strength properties.

It is also advantageous to employ additives that can be delivered to the paper machine without undue problems, if such additives are available for the given purpose. Additives that are easily dissolved or dispersed in water reduce the energy and expense of delivering them to the paper machine and provide a more reliable uniformity of feed.

DISCLOSURE OF THE INVENTION

The present invention provides a papermaking process in which the paper product, that is paper or paperboard or the like, is made by the general steps of forming an aqueous cellulosic slurry, subjecting such slurry to at least one shear stage, and dewatering such slurry to form a paper product sheet, which process is characterized by unique steps concerning the sequence and point of addition of certain additives. The process includes the addition of a mineral filler and a cationic charge-biasing species (cationic species) to the slurry prior to at least one shear stage, which additions and points of addition are also generally known for papermaking processes. The dewatering of the slurry to form a paper product sheet generally comprises draining the slurry and then drying the sheet formed thereby.

The unique steps of the present invention are the addition of an anionic flocculant to the slurry ahead of at least one shear stage, but subsequent to the addition of the mineral filler and cationic charge-biasing agent, and the addition of a certain microparticle after the last shear stage but prior to sheet formation. The addition of an anionic flocculant is known generally in papermaking processes, but in the process of the present invention it is added before at least one of the shear stages, unlike conventional processes in which high shear is to be avoided after anionic flocculant addition. The certain microparticle is an inorganic, cationic source of aluminum, described in more detail below. This microparticle is added to provide, together with the anionic flocculant, retention performance.

The application of a shear stage after the anionic flocculant has been charged to the slurry, and hence has effectuated floc formation, is discussed in more detail below. Also discussed and demonstrated below is the efficacy of the anionic flocculant and certain microparticle combination in providing retention performance.

PREFERRED EMBODIMENTS OF THE INVENTION

The treatment of an aqueous cellulosic slurry with a cationic charge-biasing species, for instance cationic starch, is a wet-end papermaking treatment in itself known in the field. For instance, in "Microparticles in Wet End Chemistry", noted above, substantial retention effect is attributed to cationic starch alone in alkaline wet end use, and cationic starch is the first of the two-component microparticle system described therein. Alum, another cationic charge-biasing agent, is also known for wet end use, particularly as an adjunct to other retention aids. Anionic flocculants are also in themselves known as wet end retention aids. For instance, anionic polyacrylamide is well known for use as a retention aid in cellulosic slurries pretreated with alum or a low molecular weight cationic resin. Even the use of microparticles is known in wet end papermaking chemistry.

The present invention departs from the known uses of anionic flocculants and microparticles. Instead of the known coagulant/shear/flocculant sequence, or the known cationic/shear/microparticle sequence, in the present invention both a cationic charge-biasing species (which may be a coagulant) and an anionic flocculant are charged to the furnish before a shear stage of the papermaking process.

The present invention also departs from the typical uses of aluminum sources as pre-flocculant coagulant additives. While aluminum sources may be employed in the present invention as the pre-flocculant coagulant additive, an aluminum source may herein be the microparticle species which is added after the flocculant, and after the anionic-flocculant-containing slurry is subjected to a shear stage. Such aluminum source that may be suitable as the microparticle species in the present process includes alum (aluminum sulfate), sodium aluminate, polyaluminum chloride, and the like. In preferred embodiment polyaluminum chloride is the microparticle species employed.

In preferred embodiments, the present invention's unique combination of addition points and sequences provides a advantageous high degree of retention of fines and fillers. Such high retention permits, for a given grade of paper, a reduction in the cellulosic fiber content of such paper, reducing papermaking costs and reducing the cellulosic fiber consumption of papermaking. Such high retention also reduces the amount of such fines and fillers that are lost to the white water, and hence reduces the material wastes, the waste disposal costs and the adverse environmental effects from such material wastes.

The present invention may also provide other advantages to the papermaking industry, such as improved dewatering and improved sheet properties such as formation and porosity and the like.

THE FILLER

The present invention is applicable to papermaking processes that use a mineral filler, or combinations of mineral fillers. Such mineral fillers include alkaline carbonates, such as calcium carbonate, clay, such as kaoline clay, talc, titanium dioxide, and the like. Such mineral fillers are particulate materials and their incorporation into the paper sheet is desired for the purpose of scattering light and hence increasing the opacity of such sheet. Calcium carbonate is a commonly used filler, and its use is generally limited to the neutral and alkaline papermaking systems because it dissolves in low pH systems. Titanium dioxide is generally more expensive than the other mineral fillers in common use, but since it has a higher refractive index than most of the other paper sheet components, it is often employed when high opacity and brightness are desired.

THE CELLULOSIC SLURRY

The present process is believed applicable to all grades and types of paper products that contain the mineral fillers described herein, and further applicable to all types of pulps including, without limitation, chemical and semichemical pulps, including sulfate and sulfite pulps from both hard and softs woods, thermomechanical pulps, mechanical pulps and ground wood pulps. It is believed, however, that the advantages of the present process are best achieved when the pulp employed is of the chemical pulp type, particularly a neutral or alkaline chemical pulp. The pulp is suspended in an aqueous slurry, often referred to herein as a cellulosic slurry, which generally contains at least about 99 weight percent water (1 percent consistency) and often contains 99.5 weight percent water (0.5 percent consistency) or more. The term "consistency" as used generally and herein refers to the weight percentage of material in a cellulosic slurry other than water.

The cellulosic slurry of the type useful for the process of the present invention will have its cellulosic content augmented with mineral filler. The amount of such mineral filler generally employed in a papermaking stock is from about 10 to about 30 parts weight of the filler, as $CaCO_3$, per hundred parts by weight of dry pulp in the slurry. The amount of such filler, however, may at times be as low as about 5, or even about 2, parts by weight, same basis. The amount of such filler may also be as high as about 40, or even 50, parts by weight, same basis.

The water employed in making up such cellulosic slurry (the process water) typically has significant hardness. The process water quality standards vary with the type of pulp used and the quality of the product being produced. For instance, a maximum total hardness, as $CaCO_3$, of about 100 ppm (100 mg/L) is a typical standard for fine paper, Kraft paper (bleached), and soda and sulfate pulp, while a standard of 200 ppm total hardness, as $CaCO_3$, is suitable and commonly encountered for groundwood pulps and blends of bleached hardwood Kraft/softwood Kraft.

The cellulosic slurry should be relatively dilute at the time of the addition of the anionic flocculant. A consistency of no more than about 3 percent is a reasonable degree of dilution, and a slurry consistency of 1.0 percent or less, at the point of anionic flocculant addition, is generally preferred. Thereafter in typical papermaking processes the cellulosic slurry would not generally be concentrated prior to sheet formation. Moreover, it would generally not be desirable to increase the slurry consistency to a higher percentage before or at the point of microparticle addition.

THE SHEAR

The cellulosic slurry is inevitably subjected to some degree of agitation throughout the papermaking process. Such general processing agitation can be, and herein is distinguished as one of two types of agitation. Such agitation is either modified agitation or shear agitation. Shear agitation occurs at processing points or stations referred to herein as "shear" or "high shear" stages. A typical cellulosic slurry will be subjected to such a modified agitation punctuated with one or more shear stages. The papermaking stations that provide a shear stage are generally a centriscreen (centrifugal cleaning devices used to remove coarse solids from the slurry prior to sheet formation, also known as a selectifier),centrifugal pumps, conventional mixing pumps and fan pumps. It is well known in the papermaking field that such shear stages break down flocs formed by flocculating agents, and hence it is the general practice to add the flocculating agent after the final shear stage encountered by the cellulosic slurry. It is convenient for the present process to have the shear or high shear provided by one or more of the shear stages inherent in the given papermaking process, and the addition points of the additives used in the present invention may be selected in view of the shear stage points in the given papermaking process. Thus the shear required for the present process may be provided by a shearing device already present in the papermaking apparatus. It is of course possible, and may at times be desirable, to include in the normal apparatus another shear device for the sole purpose of providing the shear required for the present invention's process. For instance, for a given papermaking set-up, there may be some reason it is desirable to add an anionic flocculant after the last of the shear stages in that set-up; since the slurry must be subjected to shear after such flocculant addition, a shear device must be added to the normal equipment at a point subsequent to flocculant addition. Such an additional shear device preferably is one that acts centrifugally, such as a fan pump, mixing pump, and preferably a centriscreen type of device.

THE CATIONIC CHARGE-BIASING SPECIES

As noted above, a cationic species is added to the slurry to at least partially neutralize charge on the surfaces of the filler and fines, and possibly other surfaces within the slurry, such as the cellulosic fibers larger than the fines. Most all of solids in nature have negative surface charges, including the surfaces of cellulosic fines and mineral fillers. The anionic flocculant employed in the present process generally will not be substantive to such fines and filler unless the fines and filler are pretreated with a cationic species that at least partially neutralizes such surface charge. Suitable cationic species for such partial charge neutralization include such diverse materials as relatively low molecular weight cationic starch or other cationic polymers, such as synthetic cationic polymers, and cationic coagulant-type materials. Such cationic species should provide cationic patches or anchoring points for the anionic flocculant subsequently added to the slurry.

Cationic starch is a starch material that contains tertiary amino and/or quaternary ammonium salt groups, usually at a low degree of substitution. A cationic starch may be derived from any of a number of sources, and a commonly used cationic starch is potato starch. Cationic starch is self-retaining in the cellulosic slurry; that is, it is substantive to the fines and mineral filler surfaces. In an alkaline papermaking system, a cationic starch will have a degree of flocculating activity in that cationic starch has sufficient molecular weight and stereo characteristics to provide not only anionic charge neutralization, but also some degree of bridging. Thus in an alkaline papermaking system, cationic starch is to a limited degree itself a retention aid. Cationic starch is also used in papermaking as a wet-end binder additive.

Relatively low molecular weight cationic synthetic polymers may also be used as the cationic species. Such polymers preferably should have a weight average molecular weight of no more than about 500,000, and preferably no more than about 200,000, or even about 100,000. In further preferred embodiment, such synthetic cationic polymer should have a molecular weight within the range of from about 2,000 to about 100,000.

The charge densities of such low molecular weight cationic synthetic polymers are relatively high. These charge densities typically range from about 4 to about 8 equivalents of cationic nitrogen per kilogram of polymer. The mole percent charge for cationic polymers such as epichlorohydrin/dimethyl amine copolymer or diallyldimethylammonium chloride polymer is about 100 percent. While such high charge density polymers are suitable for use as the cationic charge-biasing species, so polymers with a lesser charge density may also be suitable. For instance, an acrylamide/diallyldimethylammonium chloride copolymer may be used as the cationic charge-biasing species, particularly if the mole percent of cationic mer units is at least about 50 percent.

A cationic mer unit of a synthetic polymer typically contains a tertiary amine or quaternary ammonium salt functionality. Suitable synthetic cationic polymers include epichlorohydrin/dimethylamine polymers, polydiallyldimethylammonium chloride, polyethylene imines, and the like. Such polymers preferably are substantially linear, although some degree of cross-linking and some degree of amphoteric nature does not in and of itself exclude a cationic polymer from use as the cationic species of the process of the present invention. Such types of cationic synthetic polymers are generally all water soluble, and can be categorized as coagulants generally.

Coagulants generally are materials that reduce the surface charge on solids, and more particularly the negative (anionic) surface charge on solids suspended in aqueous medium. A coagulant is generally employed in various systems for the purpose of causing suspended solids to settle out of the aqueous medium, and hence it is generally the goal to so reduce the surface charge to the point where Van der Waals forces can predominate and cause agglomeration of the suspended particles. To achieve such agglomeration and settling, it generally is desirable to provide high intensity mixing to further promote coagulation and settling.

As noted above, relatively low molecular weight cationic polymers are considered coagulants. In addition, aluminum salts and iron salts are common coagulants, for instance alum (aluminum sulfate, usually available as a hydrate), sodium aluminate, polyaluminum chloride, ferric chloride, ferric sulfate, copperas ($FeSo_4 \cdot 3H_2O$), and the like. The metal salt coagulants also function as flocculants. Hydrolysis of such metal salts leads to the formation of insoluble gelatinous aluminum or ferric hydroxide, and they are sensitive to pH, particularly at low concentration levels. Hence while coagulant-type materials are effective anionic charge neutralizing agents, and hence can be used as cationic species in the process of the present invention, cationic starch and synthetic cationic polymers are generally a better choice.

The main purpose for the addition of the cationic species (cationic charge-biasing species) prior to the addition of the anionic flocculant is the partial neutralization of the anionic surface charges present in the slurry, which provides cationic sites for flocculant adsorption. Since the cationic charge-biasing species is generally a low molecular weight material, the effects of high shear applied after such cationic sites are formed are generally reversible. Therefore a shear stage between the addition of the cationic species and the anionic flocculant will have little to no effect on the process.

Since the cationic species is to be added ahead of the anionic flocculant, and the anionic flocculant is to be added ahead of a shear stage, at least one shear stage must follow addition of the anionic flocculant. As noted elsewhere herein, the shear stage following the flocculant addition may be a normal part of the given papermaking process, or an auxiliary shear device may be added to the process for the purpose of providing post-flocculant addition shear to the process.

The amount of cationic species that preferably is used in the process of the present invention is partly dependent on the cationic demand of the cellulosic slurry prior to addition of the cationic species. The cationic demand of the slurry is the amount of cationic species required for full anionic surface charge neutralization (to achieve a zero zeta potential), which in turn is dependent upon the amount of fines, mineral filler and other anionic surface charged particles in the slurry, and the nature and amount of other additives that may be employed for other purposes. As noted above, it is not generally necessary, and in fact at times undesirable, to employ sufficient cationic species to fully satisfy the cationic demand of the cellulosic species. Nonetheless, for a given amount of a given anionic flocculant, the cationic species pretreatment of the cellulosic slurry preferably is somewhat proportional to the cationic demand of the slurry. That is, to achieve a reasonably consistent retention performance, a high cationic demand slurry will require a greater amount of cationic species than a slurry with a low cationic demand.

The cationic species generally would be considered a cationic furnish component, and as indicated elsewhere herein it is advantageous to use a cationic furnish component that enhances the furnish in other characteristics, provided of course that such component have the desired charge-biasing activity at the level used.

In general, for a cationic starch or other cationic species with a similar charge density, an amount of cationic species of from about 0.05 to about 2.5 parts by weight per 100 parts by weight of dry slurry solids in the cellulosic slurry is both efficient and practical, and for most slurries an amount of from about 0.1 to about 2.0 weight percent, same basis, is sufficient. For cationic species having higher charge densities, for instance synthetic cationic polymers as mentioned above, which can easily be prepared with charge densities twice that of cationic starch, a lesser amount , for instance from about 0.05 to about 1.0 weight percent, same basis, will suffice.

Since the cationic species is added to the cellulosic slurry to provide a charge-biasing effect without slurry coagulation, a reasonable additive level can be determined by a colloidal titration test often used in the field to determine the cationic demand of a slurry. In this test, an excess amount of a cationic polyelectrolyte is added to a sample of the slurry. The excess cationic material is then back-titrated with an anionic polyelectrolyte to a colorimetric endpoint. The amount of cationic material required to neutralize the slurry can then be calculated.

By "charge-biasing" activity is meant herein the partial neutralization of anionic surface charge within a slurry. Hence the cationic species has a cationic charge-biasing activity in the process of the present invention.

Another polymeric substance also employed as a cationic binder in papermaking process is urea/formaldehyde resins, and such polymers are, like the cationic starch binder, suitable for use as the cationic species in the present process. Also useable are relatively low molecular weight dry strength resins that are more cationic than nonionic.

When the papermaking stock has a high cationic demand and/or contains significant amounts of pitch, a synthetic cationic polymer is often used to supplement common cationic binders. Such supplementary cationic polymers may be within the molecular weight range of from about 50,000 to about 400,000, although polymers having molecular weights as low as about 10,000, or as high as about 1, or even 2, million may at times be employed.

The term "cationic charge-biasing species", or its synonym (as used herein) "cationic species" thus includes combinations of various types of cationic species.

THE ANIONIC FLOCCULANT

A flocculant agglomerates suspended particles generally by a bridging mechanism, bridging from one surface to another and binding the individual particles into large aggregates. While alum and iron salts, as mentioned above, are considered common flocculants, for the purpose of the present invention the anionic flocculant should be a relatively high molecular weight polymer having a degree of anionic pendant groups. By polymer is meant herein, with respect to the anionic flocculant, an organic polymer having a carbon chain backbone.

Anionic polymers often have a carboxyl group (—COOH) in their structure, which may be immediately pendant from the polymer backbone or pendant through typically an alkalene group, particularly an alkalene group of few carbons. In aqueous medium, such carboxyl groups ionize to provide to the polymer structure negative (anionic) charges, except in low pH mediums.

Anionic polymers suitable for use as anionic flocculants, for instance anionic polymers of relatively high molecular weights, are not comprised wholly of mer units having pendant carboxyl groups, but instead are comprised of a combination of nonionic and anionic mer units, and may even contain a degree of cationic mer units as long as, between the anionic and cationic mer units, the anionic mer units predominate.

Mer units, as such term is used herein, refers to a portion of the polymer structure that contains two adjacent backbone carbons and any groups pendant from such carbons. For polymers prepared from ethylenically unsaturated monomers, a mer unit is comparable to the monomer molecule, with the loss of course of the ethylenic unsaturation. Hence polymer mer units are often, as herein, defined in terms of the ethylenically unsaturated monomer that did, or could have, given rise to the polymer mer unit.

Since nonionic mer units, particularly nonionic mer units with pendant polar groups, may exhibit the same flocculating properties as anionic mer units in aqueous medium, the incorporation of such nonionic mer units into the anionic flocculant is not uncommon. A particularly advantageous nonionic mer unit is the (meth)acrylamide mer unit.

Anionic polyacrylamides having relatively high molecular weights are well known as highly satisfactory flocculating agents. Such anionic polyacrylamides contain a combination of (meth)acrylamide mer units and (meth)acrylic acid mer units, the latter of which may be derived from the incorporation of (meth)acrylic acid monomer during polymer preparation, or alternatively by the hydrolysis of some (meth)acrylamide mer units after polymer preparation, or even by a combination of such methods.

The anionic charge density of suitable anionic flocculants, in terms of mole percentages of anionic mer units, should be at least 2, or about 5, mole percent of anionic mer units. In more preferred embodiment, the anionic charge density of the anionic flocculant should be from about 10 to about 60, or even 70, mole percent of anionic mer units.

The anionic flocculant should have a weight average molecular weight of at least 500,000, and preferably the molecular weight is above 1,000,000, and may advantageously be above 5,000,000, for instance in the range of from about 5,000,000 to about 20,000,000 or higher. The anionic flocculant is substantially linear; it may be wholly linear or it can be slightly cross-linked provided that its structure is still substantially linear in comparison to the typical globular structure of cationic starch.

When the anionic flocculant employed is an anionic polyacrylamide, the molecular weight, in terms of reduced specific viscosity ("RSV"), as determined in 1N sodium nitrate aqueous solution, using 0.045 weight percent of the polymer, may be as low as about 10, or at times even 5, and as high as about 60. In preferred embodiment the RSV of such anionic polyacrylamide is from about 10 to about 50, and more preferably from about 20 to about 50.

Other sources of a carboxyl group that may be present in an anionic polymer include mer units of ethyl acrylic acid, crotonic acid, itaconic acid, maleic acid, salts of any of such acids, anhydrides of any diacids, and mer units that have pendant groups covertible to ionizable carboxylate groups, and the like. Nonetheless the use of polymers prepared from (meth)acrylamide and (meth)acrylic acid, or prepared from (meth)acrylamide followed by partial hydrolysis, is generally most convenient, such polymers being easily synthesized and readily available commercially.

The anionic flocculant may also be a polymer that contains ionizable anionic groups such as sulfonate, phosphonate and the like, and combinations of any of the ionizable anionic groups mentioned herein.

Some degree of amphoteric nature in the anionic flocculant is not excluded herein, provided of course that such cationic mer unit content of such a polymer is not predominant. When the anionic flocculant is a polyampholyte, in preferred embodiment the mole percentage of cationic mer units therein does not exceed about 15 mole percent, and hence in preferred embodiment the mole percentage of cationic mer units in the anionic flocculant is from 0 to about 15 mole percent. In further preferred embodiment, where some amount of cationic mer units are present in the anionic flocculant, the mole percentage of anionic mer units is at least twice the mole percentage of such cationic mer units.

The anionic polymer may also be slightly cross linked, for instance by the incorporation of multifunctional mer units such as N,N-methylenebisacrylamide or by other cross-linking means. A degree of cross-linking that renders the polymer configuration immutably globular, or approaching such stage, is however not believed suitable for an anionic flocculant.

Mer units that provide ionizable sulfonate groups to a polymer, and hence may be included in the anionic flocculant, include without limitation sulfonated styrene and sulfonated alkyl N-substituted (meth)acrylamide. The latter includes mer units such as 2-acrylamidomethylpropane, which is commercially available as a polymerizable monomer. The latter also includes mer units formed by post-polymerization derivatization techniques, such as those described in U.S. Pat. Nos. 4,762,894 (Fong et al.) issued Aug. 9, 1988, U.S. Pat. No. 4,680,339 (Fong) issued Jul. 14, 1987, U.S. Pat. No. 4,795,789 (Fong) issued Jan. 3, 1989, and U.S. Pat. No. 4,604,431 (Fong et al.) issued Aug. 5, 1986, all of which are hereby incorporated hereinto by reference.

The preparation of polymers having ionizable phosphonate groups is described in U.S. Pat. No. 4,678,840 (Fong et al.) issued on Jul. 7, 1987, which is incorporated hereinto by reference.

It is believed that any substantially linear, anionic polymeric flocculant that is suitable for use in wet end papermaking applications is also suitable for use as the anionic flocculant of the process of the present invention, and such polymers again also include polymers having a minor degree of cross-linking and/or a minor quantity of cationic mer units providing to the polymer some minor degree of amphoteric nature.

THE MICROPARTICLE

The microparticle employed in the process of the present invention is an inorganic, cationic source of aluminum which, upon dispersion in an aqueous medium, has a particle size no larger than about 1,000 nm (0.001 mm), and typically no larger than about 500 nm (0.0005 mm). In preferred embodiment the microparticle has a particle size no larger than 300 nm (0.0003 mm). Such microparticle must be active in neutralizing anionic surface charge.

By particle size is meant herein, unless expressly indicated otherwise, the longest diameter of a particle.

A colloid has been defined at times as particulate matter, in a liquid medium, the particles of which are about, or less than, 100 nm. Other definitions of colloidal matter may place the upper ceiling as to particle size at a larger diameter, up to about 10,000 nm (0.01 mm). The latter definition includes particles that are larger than 100 nm and hence are visible by light microscope. (Below 100 nm an electron microscope must be used for detection.) The microparticle used in the process of the present invention thus may be deemed wholly colloidal under the latter broad definition of colloidal matter, while the microparticle's maximum particle size limitations do not exclude particles that are visible by light microscope.

The microparticle may, but need not, be a substantially rigid particle in aqueous medium. The microparticle may be much smaller than the maximum size limitations, for instance about 5 nm, although a minimum particle size of about 1 nm, or even about 2 nm, is believed appropriate.

The microparticle of course should not be soluble in the aqueous medium in which it is employed in the process of the present invention. The microparticle should retain its particulate nature, as to particle size range, when present in water at a concentration level as low as about 0.1 ppm, and preferably no more than about 5 weight percent of the microparticle material should become solubilized in a neutral pH aqueous medium at that concentration level during a time period of about 24 hours.

A source of aluminum as used herein means that the microparticle, as dispersed in aqueous medium, contains at least about 5 weight percent aluminum, and preferably at least about 10, or 15, weight percent aluminum.

Examples of microparticles that are inorganic, cationic sources of aluminum include, without limitation, hydrolyzed or precipitated alum ("alum" as used herein mean aluminum sulfate), polyaluminum chloride ("PAC"), polyaluminum sulfate ("PAS"), alum derivatized $SiO_2$, polyaluminosilicate, sodium aluminate, and the like. In preferred embodiment the microparticle is an aluminum salt of the type considered generally as coagulant agents, such as alum, sodium aluminate, and PAC. In more preferred embodiment, the microparticle is of the PAC type, particularly when the process employs as the anionic flocculant an anionic polyacrylamide.

Polyaluminum chloride, also referred to at times as poly(aluminum chloride) and poly aluminum chloride, or "PAC", is a partially hydrolyzed aluminum chloride, which may incorporate a small amount of sulfate. A sulfate-containing PAC may have an approximate empirical formula of $Al(OH)_{1.5}(SO_4)_{0.125}Cl_{1.25}$, and such a PAC is generally commercially available in aqueous solution form with an aluminum content of about 10 weight percent, as $Al_2O_3$. The small amount of sulfate contributes to the stability of PAC. PAC also includes partially hydrolyzed aluminum chloride complex salt structures that do not contain sulfate, for instance basic aluminum salts within the formula of $Al_n(OH)_mX_{3n-m}$ wherein n is 1 to 20, X is a monovalent anion which for PAC would of course be the Cl anion), m is a number smaller than 3n, and the chemical equivalent ratio Al/X is from 1.5 to 6.0, which salts are described in Canadian Patent No. 759,363, May, 1967, the contents of which are hereby incorporated hereinto by reference. PAC thus can be, and herein is, defined as a complex salt structure that forms polymer ions, derived from the partial hydrolysis of aluminum chloride, optionally with the incorporation of some amount of sulfate. PAC may also be, and herein is, defined by the formula of Formula I:

$$Al_n(OH)_m(SO_4)_xCl_{3n-(m+x)} \quad \text{(Formula I)}$$

wherein n is a number from about 1 to about 20, m is a number that is larger than zero and less than $3n-x$, and x is a number from zero to about 0.5n. In preferred embodiments, m varies from about a numerical value of n to about 2n. Since the inclusion of sulfate is for stability purposes generally, there seldom is reason for x to exceed a numerical value of 0.2n.

ADDITIVE ADDITION LEVELS

A reasonably efficient anionic flocculant, such as a medium charge density, high molecular weight (meth-)acrylamide/(meth)acrylic acid copolymer, may be added to the cellulosic slurry in the amount of from about 0.005 to about 0.20 parts by weight per hundred parts by weight of dry slurry solids, and preferably in the amount of from about 0.01 to about 0.1 parts by weight, same basis. Generally a greater level of anionic flocculant may be required if a less efficient flocculant is selected for use. Since generally there is little or no benefit in employing a less efficient flocculant for use in any manner in a papermaking process, the extent of augmentation required for a less efficient flocculant additive has not been investigated.

The amount of microparticle required after the floc formed by the anionic flocculant has been disrupted by one or more shear stages is dependent upon the microparticle selected. Given the use of a reasonably efficient anionic flocculant, added at recommended levels, when polyaluminum chloride is selected as the microparticle the additive level thereof may be as low as about 0.005 parts by weight per hundred parts by weight of dry solids, and at times as low as 0.001 parts by weight same basis. The maximum additive level for the microparticle in the process of the present invention for polyaluminum chloride, and for other microparticles, is dependent in part on practical considerations. For a microparticle that is extremely effective in the present process at very low dosage levels, there is believed to be a performance peak that is reached while the dosage is still very low. The performance peak dosage in any given system can of course be exceeded, and for such a microparticle such dosage beyond the performance peak is still relatively low. Nonetheless there generally is no practical reason to exceed the dosage of the performance peak, and the diminishing of retention performance that may occur when the performance peak dosage is exceeded is generally a good practical reason for avoiding such excess microparticle. For polyaluminum chloride, and any other microparticle of similar activity/dosage performance when used in the present process, it is believed that the performance peak will occur within the dosage range of from about 0.05 to about 0.20 parts by weight per hundred parts of dry solids, although variations in performance peak dosages may arise from various papermaking process parameters. For a microparticle that is effective at dosage levels higher than that required for polyaluminum chloride, for instance the sodium aluminate microparticle, the practical consideration dictating maximum dosage may be the desired add-on limit, rather than a performance peak phenomenon. A reasonable additive dosage range for sodium aluminate, and similarly active microparticles, may be from about 0.1 to about 5.0 parts by weight per hundred parts by weight dry solids. It is believed that microparticles such as aluminum sulfate will provide activities similar to sodium aluminate when used as the microparticle in the process of the present invention.

THE PAPERMAKING SYSTEM

The process of the present invention is believed particularly useful for a neutral to alkaline papermaking system, that is, a system in which the cellulosic slurry has a pH of at least about 6.0 or higher. Such pH characteristic refers to the pH of the slurry at least from the point of addition of the anionic flocculant through to the point of sheet formation. More particularly, the pH of the cellulosic slurry may be in the range of from about 6.0 to about 9.5, or preferably to about 9.0 or even 8.5.

As noted elsewhere, one particularly common filler is calcium carbonate, and the pH environments for the slurry that are noted above are suitable for this filler.

Neutral pulping processes include neutral sulfite, neutral sulfite-semichemical, and chemiground processes. Alkaline pulping processes include the Kraft and Kraft-semichemical processes. The pH of the cellulosic slurry of course may be different from that of the pulp employed by virtue of pH modifying additives.

Other additives may be charged to the cellulosic slurry without any substantial interference with the activity of the sequential additives of the present process. Such other additives include for instance sizing agents, such as alum and rosin, pitch control agents, extenders such as anilex, biocides and the like. Such other additives generally should be incorporated into the slurry at the time of addition of the anionic flocculant. Moreover, since in preferred embodiment the cellulosic slurry should be at a neutral or alkaline pH at the time the anionic flocculant is charged to the slurry, the selection of such other additives preferably should be made with this slurry pH preference as a limiting factor.

TEST METHOD

The test method employed in the following examples and comparative examples is a Britt Jar Test using a Britt CF Dynamic Dranage Jar developed by K. W. Britt of New York State University. This apparatus generally consists of an upper chamber having a capacity of about one liter and a bottom drainage chamber, the chambers being separated by a support screen and a drainage screen. Below the drainage chamber is a downward extending flexible tube equipped with a clamp for closure The upper chamber is provided with a variable speed, high torque motor equipped with a 2-inch 3-bladed propeller to create controlled shear conditions in the upper chamber. The test was conducted by placing a 750 ml. sample of the cellulosic stock in the upper chamber, and then subjecting the stock sample to the following sequence:

| Time | Action |
|---|---|
| 0 seconds | Commence shear stirring at 2,000 rpm. |
| 10 seconds | Charge Additive #1 |
| 70 seconds | Reduce stirring speed to 750 rpm. |
| 90 seconds | Charge Additive #2. |
| 100 seconds | Open the tube clamp to commence drainage from the jar, and continue drainage for 12 seconds. |

The Britt Jar filtrate collected during such 12 second drainage is generally a sample of about 200 ml. The total solids present in such filtrate is then determined by passing the filtrate sample through a preweighed filter pad which entraps solids even of colloidal size. The filter pad is then dried and reweighed, and from such total solids determination the consistency of such filtrate is calculated. The consistency of the filtrate sample is compared to the consistency of a blank (filtrate of a sample run without either Additive #1 or #2) to determine the "percent reduction in filtrate consistency" using the following equation:

$$R=(1-s/b)\times 100$$

wherein R is the percent reduction in filtrate consistency, s is the sample consistency, and b is the blank's consistency. The higher the percent reduction in filtrate consistency, the greater is the retention level achieved by an additive or combination of additives at the addition points and addition sequences used.

The specific Test Method described above simulates for Additive #1 a papermaking process wherein the cellulosic slurry is subjected to a high shear stage subsequent to the addition of material charged as Additive #1, and for Additive #2, a papermaking process wherein no high shear is applied to the cellulosic slurry during or after the addition of material charged as Additive #2. As shown in the following examples and comparative examples, the sequence and addition points of additive charges is an extremely important aspect of the process of the present invention.

THE TEST STOCK

The Test Stock used in the following examples and comparative examples was a 50/50 weight ratio blend of bleached hardwood Kraft/softwood Kraft pulp, separately beaten to a Canadian Standard Freeness value range of from 340 to 380 C.F.S., and diluted to an overall consistency (pulp dry solids and dry filler) of 0.5 percent. The dilution water contained 200 ppm of calcium hardness, 152 ppm of magnesium hardness and 110 ppm of bicarbonate alkalinity. The filler used was calcium carbonate, and it was incorporated into the stock at the level of 30 parts by weight of the filler, as $CaCO_3$, for each 70 parts by weight of dry pulp solids. The pH of this Test Stock was about 8.0 after it was completed by the addition of cationic starch as the cationic charge-biasing species, which is described generally above. The cationic starch had a degree of cationic substitution ("D.S.") of about 0.01, and it was added to the cellulosic slurry in the amount of about 20 lb. of cationic starch per ton of dry slurry solids.

EXAMPLES 1 TO 7 AND COMPARATIVE EXAMPLES A TO F

For each of Examples 1 to 7 and Comparative Examples a to f the Test Method and Test Stock described above were employed to determine the percent reduction in filtrate consistency and thus retention efficacy. In Comparative Examples a through e, varying amounts of an anionic flocculant ("AN.FLOC.") were used in the conventional manner, that is, as Additive #2, and thus no high shear was applied to the cellulosic slurry during or subsequent to its addition. In Comparative Example f, the same anionic flocculant was added as in the process of the present invention, that is, as Additive #1, but such addition was not followed by a charge of microparticle material, after the last shear stage, as required by the present invention. Examples 1 through 3 demonstrate the process of the present invention, using the same anionic flocculant (Additive #1) and, as the microparticle, sodium aluminate ("Na ALUM."). Examples 4 through 7 demonstrate the process of the present invention, again using the same anionic flocculant (Additive #1) and, as the microparticle, polyaluminum chloride ("PAC"). The anionic flocculant used was a high molecular weight, medium charge density copolymer of acrylamide and acrylic acid, containing about 30 mole percent acrylic acid mer units and having an RSV of about 30 to 36. In Table 1 below each example and comparative example is again characterized as to the materials, if any, used as Additives #1 and #2, the dosages thereof, the filtrate consistency and the percent reduction in filtrate consistency, in comparison to the blank. The dosages of the additives are given in terms of lb. of additive per dry ton solids (dry slurry solids) in the cellulosic slurry, and the dosages for sodium aluminate and polyaluminum chloride are calculated as $Al_2O_3$. In Table 2, which also follows, conversions from "lb. of additive per dry ton solids" to "parts by weight per hundred parts by weight of dry solids" for several values are given for convenience in any conversions.

TABLE 1

| Example/ Comparative Example | Additive #1 | Dosage of Additive #1 (lb/ton) | Additive #2 | Dosage of Additive #2 (lb/ton) | Filtrate Consistency (percent) | Percent Reduction in Filtrate Consistency |
|---|---|---|---|---|---|---|
| (blank) | none | — | none | — | 0.167 | — |
| a | none | — | AN.FLOC. | 0.25 | 0.141 | 15.6 |
| b | none | — | AN.FLOC. | 0.50 | 0.125 | 24.7 |
| c | none | — | AN.FLOC. | 0.75 | 0.116 | 30.5 |
| d | none | — | AN.FLOC. | 1.00 | 0.110 | 34.2 |
| e | none | — | AN.FLOC. | 1.50 | 0.089 | 46.7 |
| f | AN.FLOC. | 1.5 | none | — | 0.160 | 3.3 |
| 1 | AN.FLOC. | 1.5 | Na ALUM. | 5.00 | 0.157 | 5.4 |
| 2 | AN.FLOC. | 1.5 | Na ALUM. | 10.00 | 0.152 | 8.2 |
| 3 | AN.FLOC. | 1.5 | Na ALUM. | 30.00 | 0.087 | 47.3 |
| 4 | AN.FLOC. | 1.5 | PAC | 0.25 | 0.123 | 25.6 |
| 5 | AN.FLOC. | 1.5 | PAC | 0.50 | 0.077 | 53.8 |
| 6 | AN.FLOC. | 1.5 | PAC | 1.00 | 0.053 | 68.2 |
| 7 | AN.FLOC. | 1.5 | PAC | 2.00 | 0.067 | 59.5 |

RETENTION

The foregoing examples, particularly in contrast to the foregoing comparative examples, demonstrate generally that the process of the present invention provides a high degree of retention performance, and particularly in the preferred embodiments provides unexpectedly and surprisingly a very high degree of retention at very low additive dosage levels.

DRAINAGE AND PAPER PRODUCT QUALITIES

The process of the present invention, by virtue of its unique addition points and sequence of additives, particularly the use of shear after anionic flocculant addition, is believed to lead to improved drainage, improved maintenance of formation levels at high retention levels, and other process and paper product characteristics, such as paper product porosity.

It is noted with respect to the above examples and comparative examples that the use of sodium alumunate at a low dosage of 1.0 lb. per ton of dry solids provided no detectable effect in comparison to the use of solely the anionic flocculant in the manner shown in Comparative Example f.

TABLE 2

| Additive Dosage Conversions | |
|---|---|
| lb. of additive per dry ton solids | Parts by weight of additive per hundred parts by weight dry solids |
| 0.25 | 0.0125 |
| 0.50 | 0.025 |
| 1.00 | 0.050 |
| 2.00 | 0.100 |
| 5.00 | 0.250 |
| 10.00 | 0.500 |

TABLE 2-continued

| Additive Dosage Conversions | |
|---|---|
| lb. of additive per dry ton solids | Parts by weight of additive per hundred parts by weight dry solids |
| 30.00 | 1.500 |

DELIVERY TO THE PAPER MACHINE

The anionic flocculant employed in the process of the present invention is readily dispersible in aqueous medium and is easily charged to the papermaking process as an aqueous polymer solution.

INDUSTRIAL APPLICABILITY OF THE INVENTION

The present invention is applicable to the papermaking industry and the waste water industry as it applies to waste water generated in papermaking.

I claim:

1. A papermaking process in which a paper product is made by forming an aqueous cellulosic slurry, adding a mineral filler to said slurry, adding a cationic charge-biasing species to said slurry after said addition of said mineral filler, whereby said cationic charge-biasing species at least partially neutralizes anionic surface charges on solid surfaces in said slurry and provides cationic patches for an anionic flocculant on solid surfaces in said slurry, draining said slurry to form a sheet, and drying said sheet to form said paper product, wherein said slurry is subjected to at least one shear stage, characterized by:

adding an anionic flocculant to said slurry after said addition of cationic charge-biasing species in an amount sufficient to effectuate floc formulation, said anionic flocculant being substantially linear and having at least 2 mole percent anionic mer units and a weight average molecular weight of at least 500,000;

subjecting said slurry to a shear stage after said addition of said anionic flocculant; and subsequently adding a microparticle to said slurry prior to said draining of said slurry in an amount effective to provide improved retention performance;

wherein said microparticle is an inorganic, cationic source of aluminum having at least 5 weight percent aluminum and having a particle size distribution within the range of from about 1 to about 1,000 nm.

2. The papermaking process of claim 1 wherein said microparticle is a coagulant agent.

3. The papermaking process of claim 1 wherein said microparticle is polyaluminum chloride.

4. The papermaking process of claim 1 wherein said microparticle has a particle size maximum of about 500 nm.

5. The papermaking process of claim 1 wherein said microparticle has a particle size maximum of about 300 nm.

6. The papermaking process of claim 1 wherein said cationic charge-biasing species has a cationic charge density of from about 4 to about 8 equivalents of cationic nitrogen per kilogram of cationic charge-biasing species.

7. The papermaking process of claim 1 wherein said cationic charge-biasing species is a cationic starch.

8. The papermaking process of claim 1 wherein said cationic charge-biasing species is a synthetic polymer having at least 50 mole percent of cationic mer units and having a weight average molecular weight of 500,000 or less.

9. The papermaking process of claim 1 wherein said anionic flocculant is a synthetic polymer having at least mole percent of anionic mer units.

10. The papermaking process of claim 1 wherein said anionic flocculant is a synthetic polymer containing from about 10 to about 70 mole percent acrylic acid and/or methacrylic acid mer units.

11. The papermaking process of claim 1 wherein said anionic flocculant is a synthetic polymer having a weight average molecular weight of at least 1,000,000.

12. The papermaking process of claim 1 wherein said mineral filler is calcium carbonate and said calcium carbonate is added to said slurry in the amount of from about 2 to about parts by weight, as $CaCO_3$, per hundred parts by weight of dry pulp in said slurry.

13. The papermaking process of claim 1 wherein said slurry has a neutral to alkaline pH value at the time of said addition of said anionic flocculant.

14. The papermaking process of claim 1 wherein said slurry has a consistency of about 1 percent or less at the time of said addition of said anionic flocculant.

15. The papermaking process of claim 1 wherein said cationic charge-biasing species is added to said slurry in the amount of from about 0.05 to about 2.5 parts by weight per hundred parts by weight of dry slurry solids.

16. The papermaking process of claim 1 wherein said anionic flocculant is added to said slurry in the amount of from about 0.005 to about 0.2 parts by weight per hundred parts by weight of dry slurry solids.

17. The papermaking process of claim 1 wherein said microparticle is added to said slurry in the amount of from about 0.001 to about 5.0 parts by weight per hundred parts by weight of dry slurry solids.

18. The papermaking process of claim 1 wherein said microparticle is polyaluminum chloride and said polyaluminum chloride is added to said slurry in the amount of from about 0.005 to about 0.2 parts by weight per hundred parts by weight of said dry slurry solids.

19. The papermaking process of claim 1 wherein said microparticle is polyaluminum chloride and said polyaluminum chloride is added to said slurry in the amount of from about 0.005 to about 0.05 parts by weight per hundred parts by weight of said dry slurry solids.

20. The papermaking process of claim 1 wherein said shear stage after said addition of said anionic flocculant is provided by a centriscreen.

21. A papermaking process in which a paper product is made by forming an aqueous cellulosic slurry, adding a mineral filler to said slurry, adding a cationic charge-biasing species to said slurry after said addition of said mineral filler, whereby said cationic charge-biasing species at least partially neutralizes anionic surface charges on solid surfaces in said slurry and provides cationic patches for an anionic flocculant on solid surfaces in said slurry, draining said slurry to form a sheet, and drying said sheet to form said paper product, wherein said slurry is subjected to at least one shear stage, characterized by:

adding an anionic flocculant to said slurry after said addition of cationic charge-biasing species in an amount sufficient to effectuate floc formulation, said anionic flocculant being substantially linear and having at least 2 mole percent anionic mer units and a weight average molecular weight of at least 500,000;

subjecting said slurry to a shear stage after said addition of said anionic flocculant; and subsequently adding a microparticle to said slurry prior to said draining of said slurry;

wherein said microparticle is a polyaluminum chloride having at least 5 weight percent aluminum having a particle size distribution within the range of from about 1 to about 1,000 nm, and wherein said polyaluminum chloride is added in an amount of from about 0.05 to about 0.20 parts by weight per hundred parts by weight of dry slurry solids.

22. The process of claim 21 wherein said polyaluminum chloride has the formula of Formula I $$Al_n(OH)_m(SO_4)_xCl_{3n-(m+x)} \qquad \text{Formula I}$$

wherein n is a number from about 1 to about 20, m is a number that is larger than zero and less than $3n-x$, and x is a number from zero to about 0.5n.

23. The process of claim 22 wherein m is a number having a numerical value of from about n to about 2n.

* * * * *

UNITED STATES PATENT AND TRADEMARK OFFICE

CERTIFICATE OF CORRECTION

PATENT NO. : 5,221,435

DATED : June 22, 1993

INVENTOR(S) : J.H. Smith

It is certified that error appears in the above-identified patent and that said Letters Patent is hereby corrected as shown below:

In Column 1, line 11, after "sheet" insert -- . --.

In Column 1, line 24, after "dewater" delete " . " and substitute therefor -- , --.

In Column 2, line 60, after "tion" delete "," and substitute therefor -- . --.

In Column 7, line 12, delete "so" and substitute therefor -- some --.

In Column 8, line 6, after "follow" insert -- the --.

In Column 12, lines 56 to 57, delete "(meth-)" and substitute therefor -- (meth) --.

In Column 14, line 23, after "closure" insert -- . --.

In Column 18, line 6, which is line 3 of Claim 9, before "mole" insert -- 5 --.

UNITED STATES PATENT AND TRADEMARK OFFICE

CERTIFICATE OF CORRECTION

PATENT NO. : 5,221,435

DATED : June 22, 1993

INVENTOR(S) : J.H. Smith

It is certified that error appears in the above-indentified patent and that said Letters Patent is hereby corrected as shown below:

In Column 18, line 17, which is line 4 of Claim 12, after "about" insert --50--.

Signed and Sealed this

Eighteenth Day of January, 1994

*Attest:*

Bruce Lehman

BRUCE LEHMAN

*Attesting Officer*

*Commissioner of Patents and Trademarks*